US005248274A

United States Patent [19]

Wang

[11] Patent Number: 5,248,274

[45] Date of Patent: Sep. 28, 1993

[54] TOY VEHICLE CAPABLE OF SHOOTING COLOR RIBBON CRACKERS

[76] Inventor: Kun-Meng Wang, No. 2-2, Pei Hsin Road, Pei Hsin Li, Tai Pao City, Chiayi Hsien, Taiwan

[21] Appl. No.: 929,352

[22] Filed: Aug. 14, 1992

[51] Int. Cl.[5] ..... A63H 17/02; A63H 17/40

[52] U.S. Cl. ..... 446/6; 446/435; 446/441; 446/471; 446/486

[58] Field of Search ..... 446/4, 5, 6, 435, 441, 446/471, 486

[56] References Cited

U.S. PATENT DOCUMENTS

| | | | |
|---|---|---|---|
| 2,308,524 | 1/1943 | Longnecker | 446/4 |
| 3,668,804 | 6/1972 | Winston | 446/6 |
| 3,859,752 | 1/1975 | Morrison et al. | 446/6 |
| 3,959,920 | 6/1976 | Ieda | 446/6 |
| 4,508,521 | 4/1985 | Klimpert et al. | 446/4 |
| 4,565,537 | 1/1986 | Klimpert et al. | 446/6 |
| 4,751,197 | 2/1986 | Kulesza et al. | 446/6 |
| 4,911,669 | 3/1990 | Parker | 446/6 |

FOREIGN PATENT DOCUMENTS

| | | | |
|---|---|---|---|
| 0666111 | 9/1938 | Fed. Rep. of Germany | 446/6 |
| 1562815 | 3/1980 | United Kingdom | 446/5 |
| 1562816 | 3/1980 | United Kingdom | 446/5 |

*Primary Examiner*—Robert A. Hafer
*Assistant Examiner*—Gregory Stone
*Attorney, Agent, or Firm*—Browdy and Neimark

[57] ABSTRACT

The present invention relates to a toy vehicle capable of shooting color ribbon crackers and is characterized by a master shooting member which is normally held by a retaining means. When the bumper of the toy vehicle collides with something else, it is pushed to cause an impact link to disengage the retaining means from said master shooting member, permitting the same to impact a secondary shooting member which has a percussion head that will in turn knock a color ribbon cracker pre-mounted on the toy vehicle. The percussed cracker shall explode and disperse colored ribbons or papers of different shapes or patterns contained therein, creating interesting and joyous air.

1 Claim, 4 Drawing Sheets

TOY VEHICLE CAPABLE OF SHOOTING COLOR RIBBON CRACKERS

BACKGROUND OF THE INVENTION

The present invention relates to a toy vehicle which is capable of shooting color ribbon crackers and the like and is characterized by a collision bumper, an impact link, a spring, a flat retaining means, a shooting spring, a master shooting member, a secondary shooting member, and a color ribbon cracker provided with the toy vehicle. The color ribbon cracker may have various styles of ribbon and the like contained therein and may be shot out from the toy vehicle carrying it, creating interesting and joyous air.

Since there is not any color ribbon cracker and the like found to be mounted on a toy vehicle from which the ribbon cracker is automatically, interestingly, and joyously shot out, the applicant developed the present invention so that the conventional color ribbon crackers may be played in a completely new, interesting, and recreational manner.

SUMMARY OF THE INVENTION

The present invention has a collision bumper installed in front of the chassis of a toy vehicle, the collision bumper has a generally triangular member which extends backward from the inner side of the bumper and has a triangular opening formed therein, near the point of the triangular member, for receiving a retaining rod therein. Two guide blocks are provided on the chassis near two outer sides of the triangular member of the bumper, allowing the front point of the triangular member to contact an impact link when the bumper is subjected to a front collision force. The impact link is located between a pair of guide rails fixed on the chassis of the toy vehicle, with its front end pointing to the triangular member and its rear end pointing to a flat retaining member pivotably fixed on the chassis and positioned at an adequate distance from the impact link. One lateral end of the flat retaining member is connected to and thereby bound by a spring, and the opposite lateral end thereof points to a master shooting member, with an adequate distance from a projected portion provided at the inner side of the master shooting member. The master shooting member is flatly laid on the chassis of the toy vehicle, and has a front projected end for a shooting spring to be put thereon, and a bottom projected key downward projecting out of an opening formed on the chassis. A secondary shooting member is further provided on the chassis with its shaft pivotly fixed on and between a pair of lug seats mounted on the chassis. When the secondary shooting member is impacted by the master shooting member and turns about its shafts, its percussion head shall move in a circle to percuss a bottom trigger core of a color ribbon cracker being positioned in a U-shaped compartment formed in the toy vehicle body.

The primary object of the present invention is to provide a toy vehicle on which a color ribbon cracker is pre-mounted and can be instantaneously shot out when the toy vehicle collides with something else.

BRIEF DESCRIPTION OF THE DRAWINGS

The structure of the present invention and the performance it accomplishes may be best understood through referring to the following detailed description of the preferred embodiment and the accompanying drawings wherein.

DETAIL DESCRIPTION OF THE PREFERRED EMBODIMENTS

Figure 1:
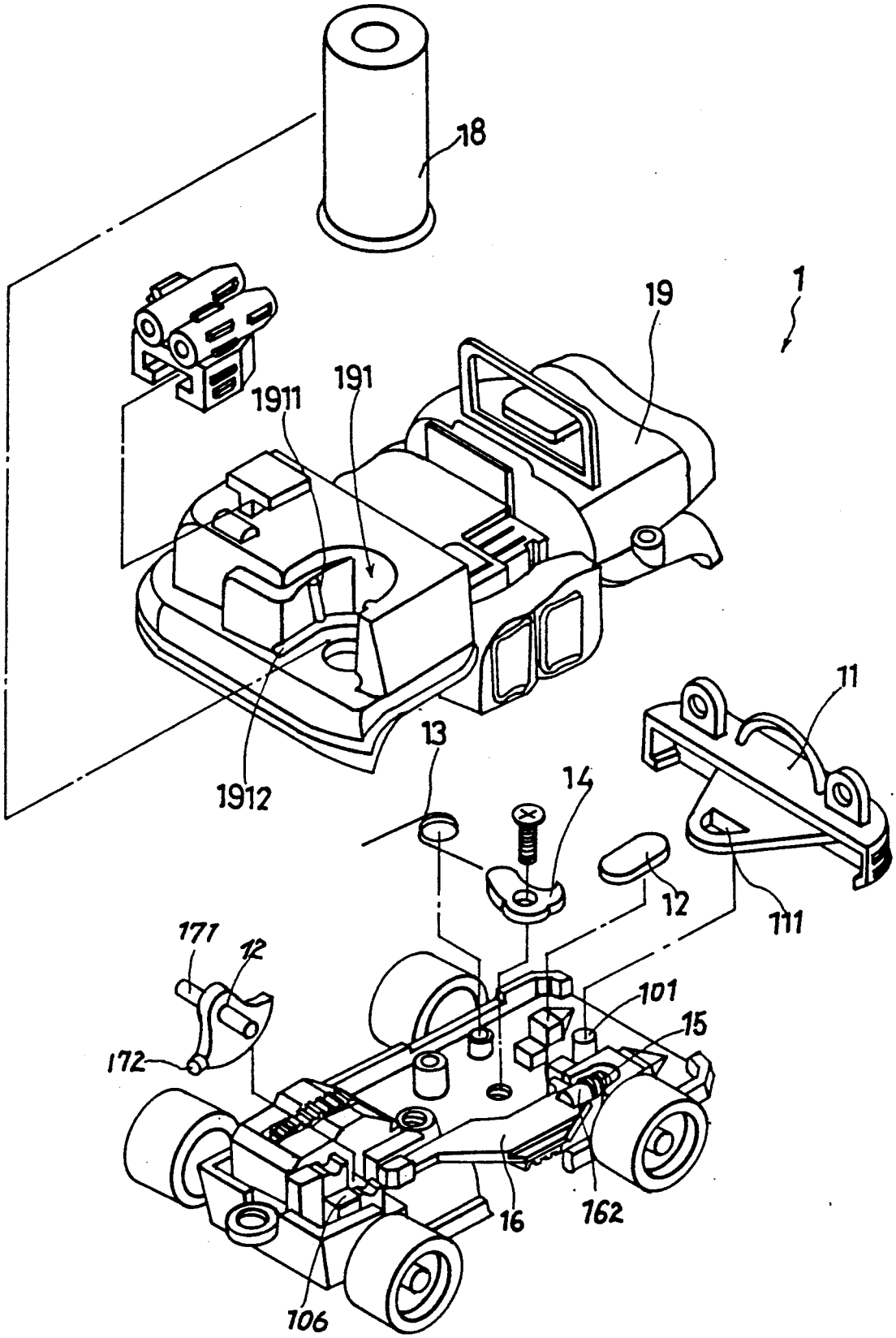
FIG. 1 is a three-dimensional analytical perspective of the present invention.
Figure 2:
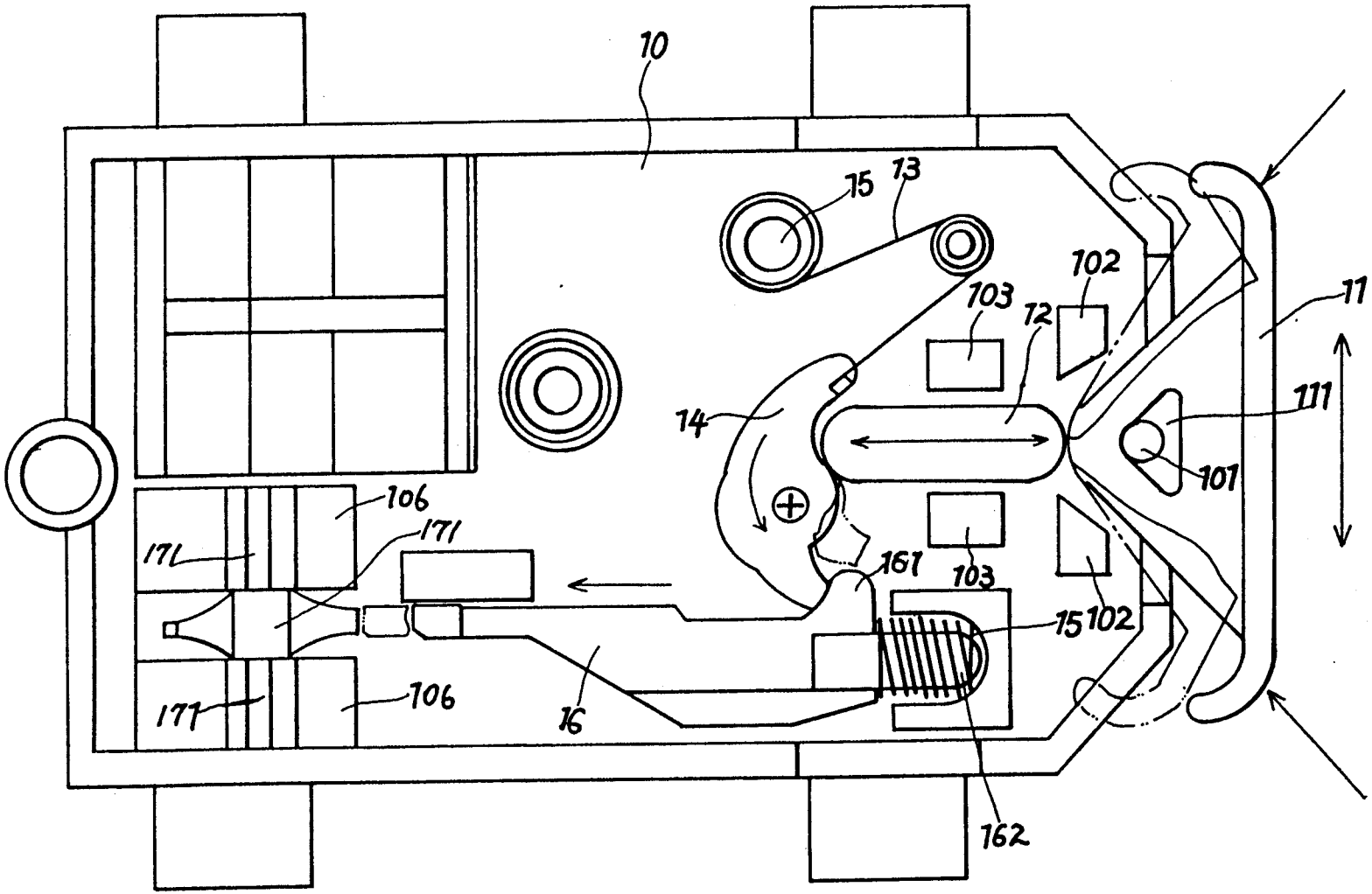
FIG. 2 is a top view illustrating the operation of the present invention.

Referring to FIG. 1 or FIG. 2, the present invention mainly consists of a general toy vehicle 1 on a chassis 10 thereof a collision bumper 11, an impact link 12, a spring 13, a flat retaining means 14, a shooting spring 15, a master shooting member 16, a secondary shooting member 17, and a color ribbon cracker 18 are particularly installed.

Figure 4:
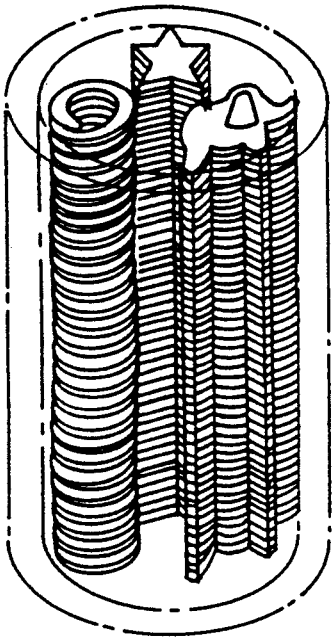
FIG. 4 is a perspective of the color ribbon cracker used in the present invention.

The collision bumper 11 is installed at front head of the chassis 10, and has a generally triangular member extended backward from its inner side. The triangular member is formed of a generally triangular opening 111 near its pointed end for receiving a retaining rod 101 therein while the retaining rod 101 is fixed to the chassis 10. Two guide blocks 102 are fixed to the chassis 10 at positions near two outer sides of the triangular member, allowing the same to move therebetween and touches the elongate impact link 12 when the collision bumper 11 is subjected to any front or lateral collision force. The impact link 12 is positioned and back and forth movable between a pair of guide rails 103 fixed to the chassis 10 and normally keeps an adequate distance from the flat retaining means 14. The retaining means 14 is generally V-shaped in configuration and is pivotly fixed to the chassis 10 with one lateral end thereof connected to and held by the spring 13. The other lateral free end of the retaining means 14 extends toward a retaining wing 161 laterally projected from inner side of the master shooting member 16 with an adequate space left therebetween. The master shooting member 16 is flatly laid and fixed on the chassis 10 and has a front projected portion 162 for receiving the shooting spring 15 thereon. A projected key 163 is provided at bottom face of the master shooting member 16 and is allowed to extend downward through a groove formed on the chassis 10. The secondary shooting member 17 has a shaft 171 with its two ends laterally extended to just locate on and be pivotly fixed to a pair of lug seats 106 such that the secondary shooting member 17 may turn about the shaft 171 and a percussion head 172 formed at one of the two longitudinally extended ends of the secondary shooting member 17 is allowed to face either the moving direction of the master shooting member 16 or a bottom trigger core of the color ribbon cracker 18 pre-mounted in a U-shaped compartment 191 provided near rear portion of the to y vehicle body 19. The U-shaped compartment 19 has retaining ribs 1911 provided at arcuate inner wall surface thereof and an annular elastic retainer 1912 provided at the lower edge thereof for holding the color ribbon cracker 18 therein. As shown in FIG. 4, ribbons and papers of different colors and different shapes or patterns may be contained in the cracker 18 to create interesting and joyous air when the cracker 18 explodes.

Figure 3:
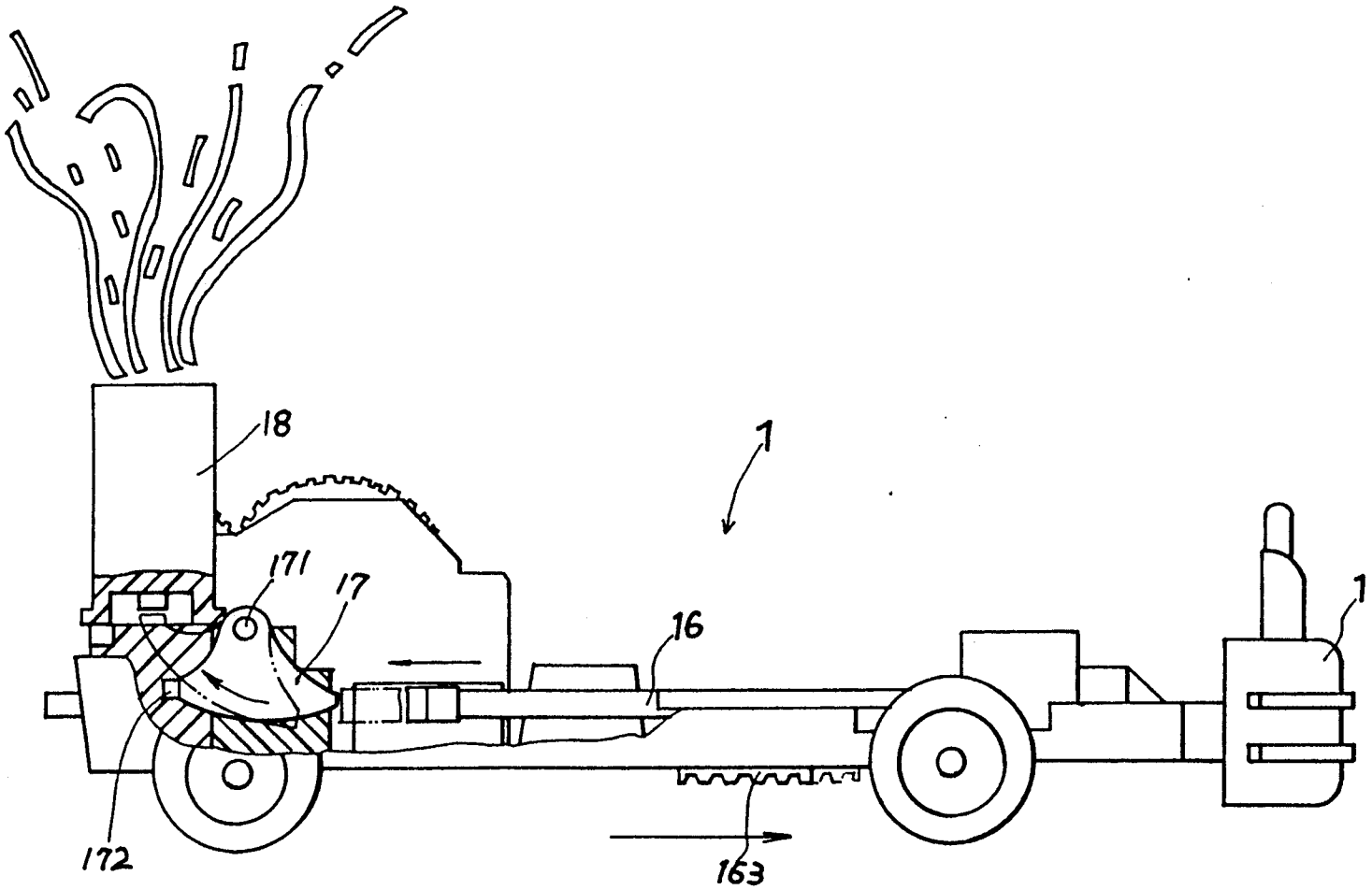
FIG. 3 is a side view illustrating the operation of the present invention.

Please now refer to FIGS. 2 and 3 for the manner in which the present invention is operated. First place a color ribbon cracker 18 filled with ribbons and papers of different colors and different patterns or shapes into the U-shaped compartment 191, permitted it to be fitly clamped by the retaining ribs 1.91.1 and the annular elastic retainer 1912. Then, push the projected key 163 of the master shooting member 16 toward the front of the chassis 10 to the extent that the master shooting member 16 compresses the shooting spring 15 until the laterally and inwardly extended retaining wing 161 is retained by the free end of the flat retaining means 14 and the master shooting member 16 is prevented from springing back by the shooting spring 15. At this point, the toy vehicle 1 may be started. Whenever the toy vehicle 1 collides with something else in the course of travelling and the collision bumper 11 is subjected to either a lateral or a front force, the collision bumper 11 shall be pushed to move backward between the two guide blocks 102 and touches the impact link 12. The impact link 12 will then attack the free end of the flat retaining means 14 being held by the spring 13, causing the free end of the flat retaining means 14 to disengage from the retaining wing 161 of the master shooting member 16. At this point, the energy stored in the shooting spring 15 shall immediately cause the master shooting member 16 to dash toward the rear end of the chassis 10 and impact the secondary shooting member 17 at the percussion head 1.72 thereof. Since the secondary shooting member 17 is pivotly fixed to the, chassis 10 by means of its shaft 171, the percussion head 172 is allowed to turn about the shaft 171 in the direction the force applied to it by the master shooting member 16. The percussion head 172 shall therefore turn upward to percuss the bottom trigger core of the color ribbon cracker 18 just above the percussion head 172, causing the cracker 18 to explode and disperses the colored ribbons and papers in the cracker 18.

The present invention is characterized by that the color ribbon cracker 18 filled with color ribbons or papers of different shapes or patterns is carried by a toy vehicle and would be shot out and explode the minute the toy vehicle collides with something else. It is a completely new, interesting, and recreative way to use a color ribbon cracker.

What is claimed is:

1. A toy vehicle capable of shooting color ribbon crackers comprising:

a collision bumper installed at the front end of a chassis of said toy vehicle, having a generally triangular member which extends backward from the inner side of said bumper and has a generally triangular opening formed therein near the pointed end thereof for receiving a retaining rod fixed to said chassis of said toy vehicle;

two guide blocks fixed on said chassis at positions near two sides of said triangular member such that said triangular member shall be guided to move between said two guide blocks when said collision bumper is subjected to either a front or a lateral collision force;

an impact link being longitudinally clamped between a pair of guide rails fixed on said chassis with one front end of said impact link pointing to said triangular member of said collision bumper and being movable backward when it is pushed by said triangular member due to collision of said collision bumper with something else;

a flat retaining means having a generally V-shaped configuration and being pivotly fixed to said chassis positioned behind said impact link, one lateral end of said flat retaining means being connected to and thereby held by a spring fixed to said chassis, and the other lateral free end of said flat retaining means being touchable by said impact link and thereby moving backward when said collision bumper collides with something else;

a master shooting member flatly laid on said chassis with a bottom key downward projected out of said chassis through a groove formed thereat; said master shooting member having a laterally projected retaining wing which contacts said other lateral free end of said flat retaining means, and a front projected portion onto there a shooting spring is received; said bottom key, and said master shooting member, accordingly, being able to be pushed toward the front end of said chassis, causing said shooting spring to be compressed until said retaining wing of said master shooting member engages with and is thereby retained by said flat retaining means at said free end thereof; said retaining wing being disengaged from said lateral free end of said flat retaining means when said flat retaining means is pushed back by said impact link at the time said collision bumper collides with something else; said shooting spring being able to spring said master shooting member toward the rear end of said chassis when said retaining wing of said master shooting member disengages from said lateral free end of said flat retaining means; and a secondary shooting member having a shaft two ends of which laterally extend to be pivotly held by a pair of lug seats fixed on said chassis, allowing said secondary shooting member to turn about said shaft when said master shooting member is sprung and dashes toward the rear portion of said chassis, said secondary shooting member having a percussion head which normally faces said master shooting member and shall be turned around in a direction in which a force is applied to it by said master shooting member when said retaining wing disengages from said flat retaining means and permits said shooting spring to recover its normal status, that is, pushing said master shooting member backward, and thereby to face a bottom trigger core of a color ribbon cracker pre-mounted in a Ushaped compartment formed at the rear portion of the body of said toy vehicle; said U-shaped compartment having retaining ribs and an annular elastic retainer for fitly holding said color ribbon cracker therein; said color ribbon cracker having colored ribbons or papers of different shapes or patterns contained therein and being able to explode and disperse said ribbons and papers therein to form interesting and joyous air.

* * * * *